US007191702B2

(12) United States Patent
Kercher

(10) Patent No.: US 7,191,702 B2
(45) Date of Patent: Mar. 20, 2007

(54) METHOD FOR APPLYING INK

(76) Inventor: Jon S. Kercher, 15101 Blue Ash Dr., Apt. 608, Houston, TX (US) 77090

( * ) Notice: Subject to any disclaimer, the term of this patent is extended or adjusted under 35 U.S.C. 154(b) by 327 days.

(21) Appl. No.: 10/282,829

(22) Filed: Oct. 29, 2002

(65) Prior Publication Data

US 2004/0078868 A1 Apr. 29, 2004

(51) Int. Cl.
*B41F 15/00* (2006.01)
*B41M 1/12* (2006.01)
*B41M 7/00* (2006.01)

(52) U.S. Cl. ..... 101/129; 101/483; 101/487; 101/488; 101/127

(58) Field of Classification Search ..... 101/123, 101/114, 126, 35, 129; 2/10, 195.6, 175.4, 2/195.1
See application file for complete search history.

(56) References Cited

U.S. PATENT DOCUMENTS 4,266,476 A * 5/1981 Maloof ..... 101/35
4,395,964 A * 8/1983 Warren ..... 112/475.08
4,438,693 A * 3/1984 Serrianne et al. ..... 101/129
4,478,144 A * 10/1984 Maloof ..... 101/126
4,551,860 A * 11/1985 Smit et al. ..... 2/209.7
4,590,854 A * 5/1986 Anderson ..... 101/35
4,753,161 A * 6/1988 Kimball ..... 101/35
RE32,731 E * 8/1988 Jennings et al. ..... 101/35
5,014,614 A * 5/1991 Thieme ..... 101/35
5,070,545 A * 12/1991 Tapia ..... 40/329
5,218,908 A * 6/1993 Whitfield ..... 101/487
5,649,480 A * 7/1997 Yim ..... 101/129
5,701,607 A * 12/1997 Kaiser ..... 2/209.13
5,729,833 A * 3/1998 Judge ..... 2/195.1
5,754,983 A * 5/1998 Landers ..... 2/195.1
5,845,339 A * 12/1998 Ashley et al. ..... 2/195.6
5,908,000 A * 6/1999 Spychalla et al. ..... 101/487
6,029,272 A * 2/2000 Bazin ..... 2/12
6,138,279 A * 10/2000 Gore ..... 2/175.5
6,557,180 B2 * 5/2003 Hall McKenzie ..... 2/195.1
6,766,538 B2 * 7/2004 Park ..... 2/175.4

FOREIGN PATENT DOCUMENTS

CA 2267458 A1 * 9/2000

OTHER PUBLICATIONS

Roger L. Jennings, "A Sharper Image for Caps," May 1, 2005, http://www.images-magazine.com/imagesarticle.php?article_id=10.*

* cited by examiner

*Primary Examiner*—Daniel J. Colilla
(74) *Attorney, Agent, or Firm*—Jackson Walker L.L.P.; Mark A. Tidwell, Esq.

(57) ABSTRACT

A method for silk screen printing a design on a visor of a cap using high-density ink is disclosed. The method of the present invention includes the steps of: (1) loading a fabric from which a visor of a cap will be fabricated onto a template formed in the shape of the visor of the cap; (2) printing the design on the visor of the cap using a flat panel silk screen printing apparatus and at least one high-density ink which can withstand the wear and tear experienced by the visor of the cap during normal usage; (3) curing the high-density ink by heating the ink to a predetermined temperature; (4) cutting the fabric to form the visor of the cap; and (5) assembling the cap by stitching together the fabric of the visor, inserting a visor board, and attaching the assemble visor to a headpiece.

5 Claims, 3 Drawing Sheets

METHOD FOR APPLYING INK

BACKGROUND OF THE INVENTION

1. Field of the Invention

The present invention relates to the field of silk screen printing on fabric, and, more particularly, to a method of silk screen printing by applying a high-density ink to fabric used to form the visor of a cap.

2. Description of the Prior Art

Silk screen printing is a common technique used to print designs (e.g., images, words, letters, or numbers) on a fabric such as on a shirt or a cap. Typical silk screen printing techniques require the target fabric to be stretched flat in order to receive the ink design via a flat panel silk screen. For this reason, a fabric having a curved or non-flat surface cannot readily be used to receive a design using typical flat panel silk screen printing equipment.

The visor of a cap—particularly a baseball cap—is rigid and curved. Due to the non-flat shape of the visor, it cannot be run through on a typical silk screen printing machine and thus cannot receive a design using flat panel silk screen equipment.

Furthermore, the conventional inks used in silk screen printing operations are particularly susceptible to everyday wear and tear. This poses a particular problem for silk screen ink designs on cap visors. The visor area of the cap is frequently gripped by the wearer when putting on, adjusting, or taking off the cap. Thus, the visor area experiences a significant amount of wear and tear during normal use. Since conventional silk screen printing inks are not sufficiently durable to withstand the wear and tear that the visor area of a cap experiences, the ink will eventually wear off of the visor during normal handling of the cap by the wearer.

For these reasons, an embroidery technique is commonly used to apply a design to the visor area of a cap. However, the embroidery technique fails to yield designs with the quality and detail achievable through using silk screen printing techniques. Accordingly, it would be desirable to have a method for printing a design on the visor of a cap using a typical flat panel silk screen printing apparatus and a durable ink that can withstand the wear and tear that the visor area of a cap experiences. This novel and useful result has been achieved by the present invention.

SUMMARY OF THE INVENTION

In accordance with the present invention, a method for printing a design on the visor of a cap using a typical silk screen printing apparatus is provided.

The method of the present invention includes the following steps: (1) providing a fabric from which a visor of a cap will be fabricated; (2) printing the design on the visor of the cap using a flat panel silk screen printing apparatus and at least one predetermined ink; (3) curing the design by raising the temperature of the ink to a predetermined level; (4) cutting the fabric to form the visor of the cap; (5) assembling the cap by attaching the fabric of the visor to a visor board and attaching the assembled visor to a headpiece.

The method of the present invention further includes the step of providing a high-density ink for printing the design on the fabric of the visor of the cap. The high-density ink provides increased durability over conventional silk screen inks to withstand the frequent handling and wear and tear experience by the visor area of a cap.

The method of the present invention still further includes the step of loading the fabric onto a template being shaped in the form of the visor of the cap to fabric while the design is being silk screen printed thereon.

DESCRIPTION OF SPECIFIC EMBODIMENTS OF THE INVENTION

A description of certain embodiments of the present invention is provided to facilitate an understanding of the invention. This description is intended to be illustrative and not limiting of the present invention.

In the specification and appended claims, the term "design" includes—but is not limited to—"a word or words", "a letter or letters", "a number or numbers", "an image", "a pattern", or any combination of the aforementioned.

One embodiment of the present invention is a method for printing a design on the visor of a cap. This method includes silk screen printing the design on a fabric for the visor of the cap using high-density ink and a template shaped like the visor of the cap.

Figure 1:
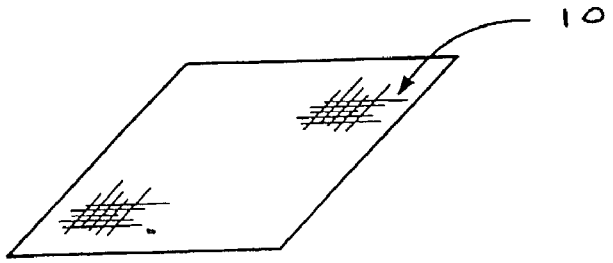
FIG. 1 is a perspective view of an embodiment of the method of the present invention depicting the step of laying out a fabric material for receiving a design for a top piece and a bottom piece of a visor of a cap.

With respect to FIG. 1, the first step of the silk screen printing method of the present invention is to choose and layout a piece of fabric material 10 from which a visor of a cap having a top piece and a bottom piece will be fabricated. It is intended that any fabric material can be used so long as it is able to absorb the ink used in the silk screen printing process.

Figure 2:
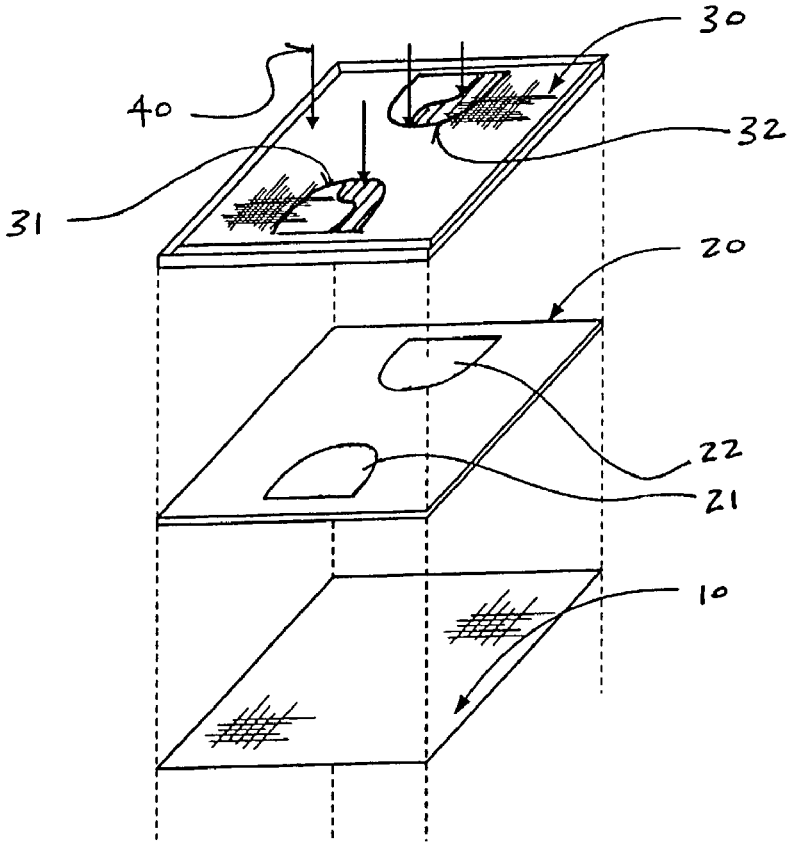
FIG. 2 is a perspective view of an embodiment of the method of the present invention depicting the step of loading the fabric material onto a template having the shape of the top piece and bottom piece of the visor and placing a flat panel silk screen over the template.

With respect to FIG. 2, the fabric material 10 is loaded onto a stainless steel template 20 for defining the shape of the visor of the cap. The template includes a stencil of the top piece 21 and the bottom piece 22 of the visor of the cap. While the template 20 of the preferred embodiment is fabricated from stainless steel, it is intended that the template can be fabricated from any hardened, durable material that can endure silk screen printing operations. Moreover, while this embodiment of the present invention includes the step of printing a design on both the top piece and on the bottom piece of the visor of the cap, it is intended that the present invention can be used for printing a design solely on the top piece of the visor or alternatively solely on the bottom piece of the visor.

Still with respect to FIG. 2, a flat panel silk screen 30 having a predetermined design 31 for the top piece of the visor and a predetermined design 32 for the bottom piece of the visor formed thereon is placed on top of the template 20 and material panel 10. While this embodiment of the present invention includes the step of providing a flat panel silk screen to implement the printing operation, it is intended that the step can be satisfied by any silk screen apparatus suitable for printing on a flat surface including, but not limited to, a silk screen printing machine.

Figure 3:
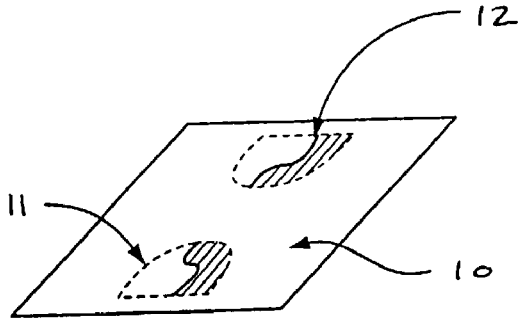
FIG. 3 is a perspective view of an embodiment of the method of the present invention depicting the step of printing the design on the fabric material using the flat panel silk screen and a high-density ink.

With respect to FIGS. 2 and 3, a high-density ink 40 is then applied to the silk screen 30 and the designs 31, 32 are washed into the fabric 10 held by the template 20 to form the top piece 11 and bottom piece 12 of the visor. The high-density ink 40 is a plastisol ink comprising a poly vinyl chloride (PVC) resin, a liquid plasticizer, and a high-density additive. Once the high-density ink 40 is applied, it is brought to a predetermined curing temperature. Once this predetermined temperature is achieved, the PVC resin expands as it absorbs the liquid plasticizer until the expanding PVC particles merge to form a capillary film. The high-density additive holds the edge defined by the capillary film. Once properly cured, the high-density ink 40 is able to stretch and retract without cracking thus making it ideal for the wear and tear experienced by the visor area of the cap.

Figure 4:
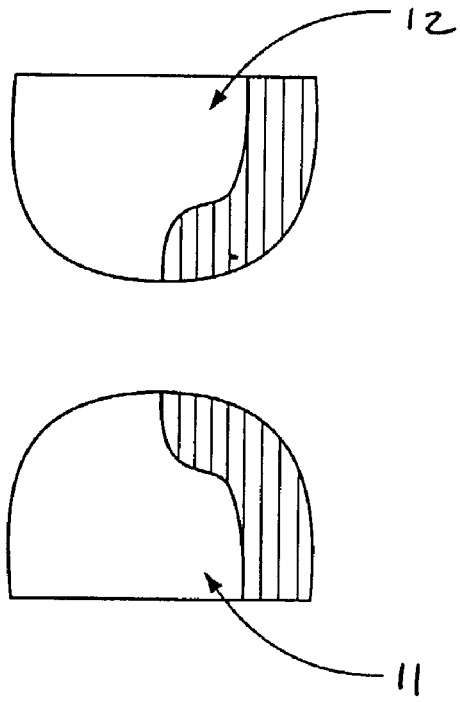
FIG. 4 is a top view of an embodiment of the method of the present invention depicting the step of cutting out the top piece and bottom piece of the visor from the fabric material.
Figure 5:
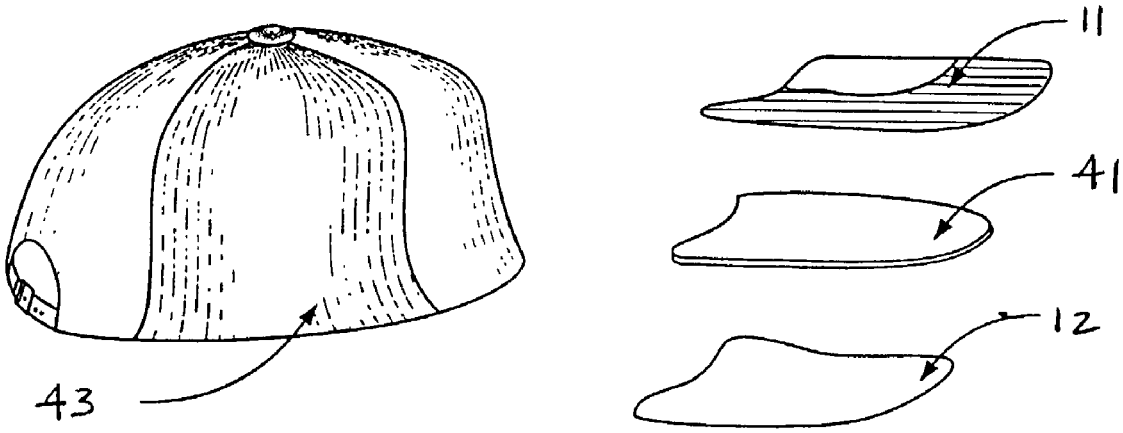
FIG. 5 is a perspective view of an embodiment of the method of the present invention depicting the steps of: (1) assembling the visor by stitching the top piece and bottom piece together and inserting a visor board between them, and (2) assembling the completed cap by stitching the assembled visor to a headpiece.

With respect to FIGS. 4 and 5, the top piece 11 and the bottom piece 12 of the visor of the cap are carefully cut out of the fabric material 10 (FIG. 3). The two pieces 11, 12 are stitched together and then a visor board 41 is inserted between the assembled pieces. The assembled visor 42 is then stitched to a headpiece 43. While the cap 40 of the preferred embodiment is assembled by stitching the components together, it is intended that the cap may be assembled by any attaching means that does not damage the high-density ink design.

Figure 6:
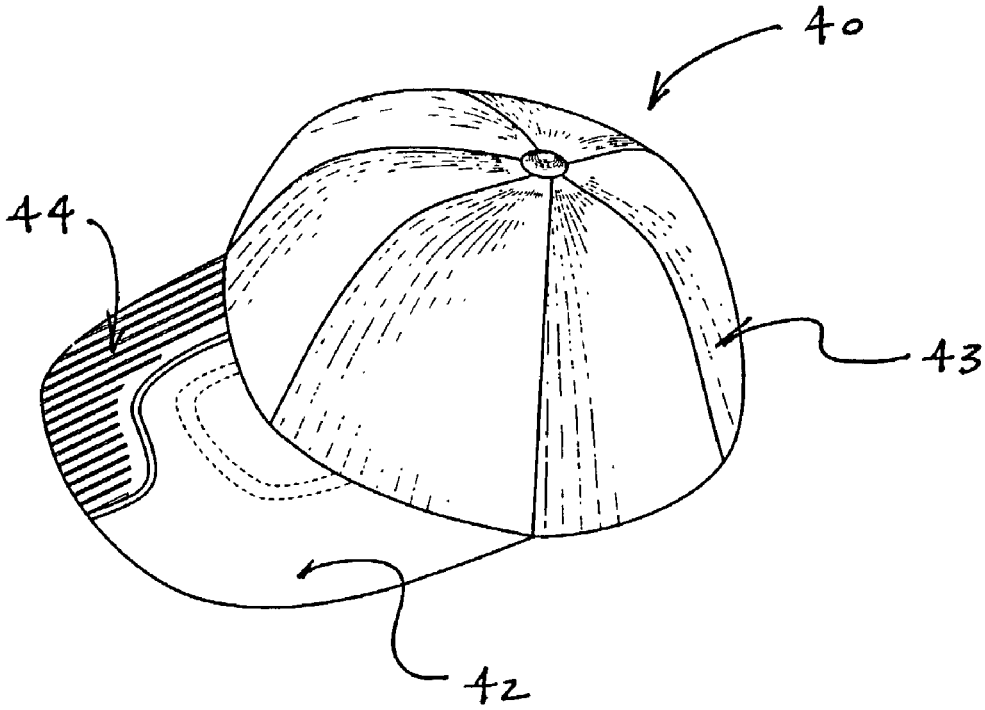
FIG. 6 is a perspective view of an embodiment of the method of the present invention depicting the completed cap having a visor with a design silk screen printed thereon.
Figure 7:
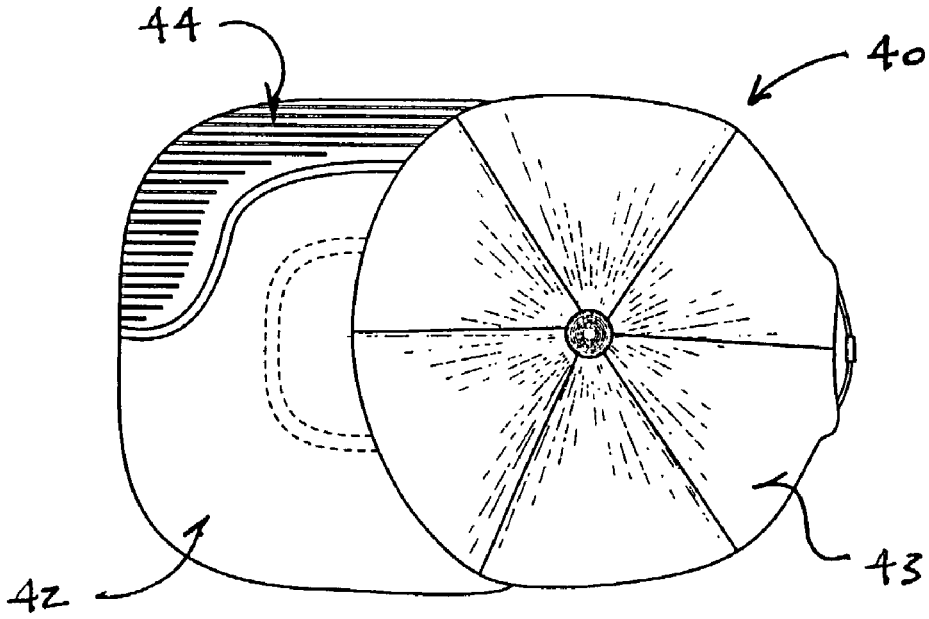
FIG. 7 is a top view of an embodiment of the method of the present invention depicting the completed cap having a visor with a design silk screen printed thereon.

With respect to FIGS. 6 and 7, the silk screening method of the present invention yields a cap 40 having a headpiece 43 and a visor 42 with a high-density ink design 44 silk screened thereto.

While the embodiment of the present invention described above includes a template for defining the shape of a top piece and a bottom piece of a single visor, it is intended that another embodiment of the present invention includes a template for defining the shape of a top piece and a bottom piece of a plurality of visors on a single template. Moreover, in still another embodiment of the present invention, the design may be printed on a fabric material using a silk screen apparatus with the fabric stretched out over a flat surface without employing a template at all.

What is claimed is:

1. A method for forming a cap having a crown portion and a visor portion defined by an upper visor surface and a lower visor surface, the method comprising the steps of:

a. printing a design utilizing a high density ink on fabric with a flat panel silk screen printing apparatus;

b. curing the design by heating the ink to a predetermined level, wherein said cured design forms a raised surface on said fabric upon curing;

c. securing a portion of said fabric to the upper visor surface so as to provide the upper visor surface with a raised design; and d. securing a portion of said fabric to the lower visor surface so as to provide the lower visor surface with a raised design.

2. The method of claim 1 further comprising the step of loading the fabric onto a template, said template being formed in the shape of the visor of the cap.

3. The method of claim 2 wherein the silk screen printing apparatus is a flat panel silk screen.

4. A method for forming a cap having a crown portion and a visor portion defined by an upper visor surface and a lower visor surface using a silk screen printing apparatus with a flat printing surface, the method comprising the steps of:

a. laying out fabric on the flat printing surface;

b. silk screen printing a design utilizing a high density ink on the fabric;

c. curing the high-density ink by heating the ink to a predetermined temperature, wherein said cured design protrudes from the fabric on which it is printed;

d. cutting the fabric to form at least a top piece or a bottom piece wherein said cut piece has a cured design portion thereon;

e. securing together the cut piece and another fabric piece to form a visor covering;

f. inserting a visor board between the secured together pieces of the visor covering of the cap so as to form a top piece adjacent the upper visor surface and a bottom piece adjacent the lower visor surface, wherein at least one of said top or bottom pieces has the cured design portion thereon; and g. securing the visor portion to the crown portion of the cap.

5. The method of claim 4, wherein each piece of said top and bottom pieces have a cured design portion thereon.

* * * * *